US007047938B2

(12) United States Patent
Flynn et al.

(10) Patent No.: US 7,047,938 B2
(45) Date of Patent: May 23, 2006

(54) DIESEL ENGINE CONTROL SYSTEM WITH OPTIMIZED FUEL DELIVERY

(75) Inventors: Paul Flynn, Fairview, PA (US); Wolfgang Daum, Erie, PA (US); Ahmed Sheikh, Erie, PA (US)

(73) Assignee: General Electric Company, Schenectady, NY (US)

( * ) Notice: Subject to any disclaimer, the term of this patent is extended or adjusted under 35 U.S.C. 154(b) by 180 days.

(21) Appl. No.: 10/770,676

(22) Filed: Feb. 3, 2004

(65) Prior Publication Data

US 2005/0171655 A1 Aug. 4, 2005

(51) Int. Cl.
*F02D 31/00* (2006.01)

(52) U.S. Cl. ..... 123/352; 123/357; 123/687; 123/704

(58) Field of Classification Search ..... 123/352, 123/357, 687, 704, 674, 675
See application file for complete search history.

(56) References Cited

U.S. PATENT DOCUMENTS 5,069,184 A * 12/1991 Kato et al. ..... 123/492
5,345,916 A 9/1994 Amann et al.
5,429,089 A * 7/1995 Thornberg et al. ..... 123/352
5,595,163 A 1/1997 Nogi et al.
6,158,416 A 12/2000 Chen et al.
6,253,546 B1 * 7/2001 Sun et al. ..... 60/285
6,283,100 B1 9/2001 Chen et al.
6,286,311 B1 * 9/2001 Chen ..... 60/599
6,286,480 B1 9/2001 Chen et al.
6,295,816 B1 * 10/2001 Gallagher et al. ..... 60/611
6,318,308 B1 11/2001 Hsu et al.
6,325,044 B1 12/2001 Chen et al.
6,325,050 B1 12/2001 Gallagher et al.
6,327,980 B1 12/2001 Chen et al.
6,341,596 B1 1/2002 Dillen et al.
6,349,706 B1 2/2002 Hsu et al.
6,405,705 B1 6/2002 Dunsworth et al.
6,493,627 B1 12/2002 Gallagher et al.
6,725,134 B1 4/2004 Dillen et al.
6,823,835 B1 11/2004 Dunsworth et al.
2002/0148438 A1 * 10/2002 Ellims et al. ..... 123/352
2003/0130785 A1 * 7/2003 Ishikawa et al. ..... 123/352

* cited by examiner

*Primary Examiner*—Erick Solis
(74) *Attorney, Agent, or Firm*—Enrique J. Mora; Beusse, Wolter, Sanks, Mora & Maire, P.A.

(57) ABSTRACT

A system (400) and method of determining fuel demands of a locomotive engine (10) based upon engine speed and power produced by the engine at a given time, so to optimize the engine's power output for a load while reducing engine emissions. The engine control architecture comprises three interrelated control loops (100–300). A primary feedback control loop (100) employs integral type control with gain scheduling to regulate engine speed to commanded slew rated based upon the locomotive's operator commands. A second control loop (200) provides an active, feed forward or predictive control consisting of a plurality of correction functions each utilizing a Taylor series having coefficients for each term in the series, the coefficients being modified to adapt the system to the engine with which it is used. A control third loop (300) optimizes reference speed slew rates and engine load rates by providing feedback of nominal engine fuel requirements or fuel demand, corrections to fuel demand based upon outputs from the second control loop, speed error values, and ambient conditions.

36 Claims, 4 Drawing Sheets

DIESEL ENGINE CONTROL SYSTEM WITH OPTIMIZED FUEL DELIVERY

CROSS-REFERENCE TO RELATED APPLICATIONS

None.

STATEMENT REGARDING FEDERALLY SPONSORED RESEARCH OR DEVELOPMENT

Not Applicable.

BACKGROUND OF THE INVENTION

This invention relates to diesel powered locomotives; and more particularly, to a system and a method controlling the supply of fuel to the locomotive's engine. The method utilizes speed and load information for the engine, and other engine operating information, to dynamically react to changes in engine load or other conditions which impact the engine's fuel requirements, predict fuel demand in response to these changes so to control engine speed, optimize the power output of the engine, prevent oversupply of fuel to the engine, and substantially reduce residual smoke and other regulated emissions the engine may produce. The system and method employ an adaptive capability by which, over time, coefficients utilized in producing the dynamic response are optimized for the particular engine and the environment in which the engine operates.

Adaptive control systems for controlling operation of a locomotive's diesel engine are currently available to supply fuel to the engine based upon sensed air pressure and the power output demanded from the engine. These systems take into account engine protection schemes (such as over speed protection) that prevent damage to the engine if it attempts to perform beyond its capabilities for a particular set of operating conditions. Two factors not taken into account by current control systems are: a) the time it actually takes to combust the fuel delivered to the engine; and, b) combustion chamber cooling effects which result from supplying too much fuel to the engine. Among other factors, the time it actually takes to combust fuel delivered to an engine is determined by:

i) the engine's operating temperature;

ii) pressure within the engine; and, iii) the engine's operating speed (rpm).

If too much fuel is supplied to the engine for a given set of operating conditions, some of the fuel will not be combusted. This results in an excessive amount of smoke being produced by the engine. Excessive smoke will result in the locomotive's operation exceeding allowable emission standards.

As importantly, delivering too much fuel to the engine does nothing to increase to the amount of power (torque) produced by the engine. If the amount of fuel delivered to the engine continues to increase, the temperature in the engine's combustion chambers (cylinders) will fall. This results in a loss of power and reduces the engine's efficiency. There is also a substantial increase in the cost of operating the locomotive because of the fuel being wasted, especially since the engine obtains no benefit from the oversupply of fuel.

Current control systems are essentially reactive systems. That is, when a change occurs which results in the engine demanding more or less fuel so to produce more or less power, the systems utilize static look-up tables which provide a predetermined listing of sets of engine conditions and corresponding engine fuel demand and an engine fuel delivery schedule. To transverse from one set of operating conditions to another when a change occurs, these systems move in a step manner so that movement from the old operating point to the new one occurs incrementally. This is not to say that current systems do not respond adequately to sensed changes; but rather that the response could occur much more rapidly, and hence improve overall efficiency of engine operation while still not exceeding emission levels or otherwise detrimentally affecting engine operation.

By implementing an overall control methodology using an adaptive control scheme for an engine control unit (ECU), it is now possible to provide a dynamic look-up table functionality that "learns" from a particular engine's past performance so as to tailor the system's response for a particular engine's fuel demands based upon the particular range of operating conditions experienced by the engine. This results in an efficient, faster responsive, and more powerful control methodology than is currently available.

BRIEF SUMMARY OF THE INVENTION

Briefly stated, the present invention relates to a method of controlling fuel delivery to a locomotive's diesel engine so to optimize fuel delivery and promote efficient combustion of the fuel, maximize engine performance, and reduce emissions. Importantly, the method provides both a dynamic response to changes in operation and a learning capability by which an engine's control system becomes uniquely adapted to the particular engine, over time.

The method employs three interrelated engine control loops by which a desired level of fuel needed by the engine is determined based upon engine operating parameters. A first loop utilizes factors related to engine speed. A second loop utilizes factors related to fuel demand and employs Taylor series functions. A separate Taylor series is utilized for each parameter used to determine engine performance for each set of engine operating conditions, and these coefficients are modified, over time, to the particular engine so as to be unique for that engine. The third loop takes inputs from the other two loops and combines them with other information to optimize engine performance and reduce emissions.

By controlling fuel delivery in response to the control method of the invention, the engine's output power is maximized for a given operating speed, better fuel delivery is achieved, the amount of smoke in the engine's exhaust is minimized, and other emissions' levels are reduced. This, in turn, allows the engine's operation to be controlled for peak performance for a given set of operating conditions, while reducing engine operating costs.

The foregoing and other features and advantages of the invention will become more apparent from the reading of the following description in connection with the accompanying drawings.

BRIEF DESCRIPTION OF THE SEVERAL VIEWS OF THE DRAWINGS

In the accompanying drawings which form part of the specification.

Corresponding reference characters indicate corresponding parts throughout the several views of the drawings.

DESCRIPTION OF THE PREFERRED EMBODIMENT

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

Figure 1:
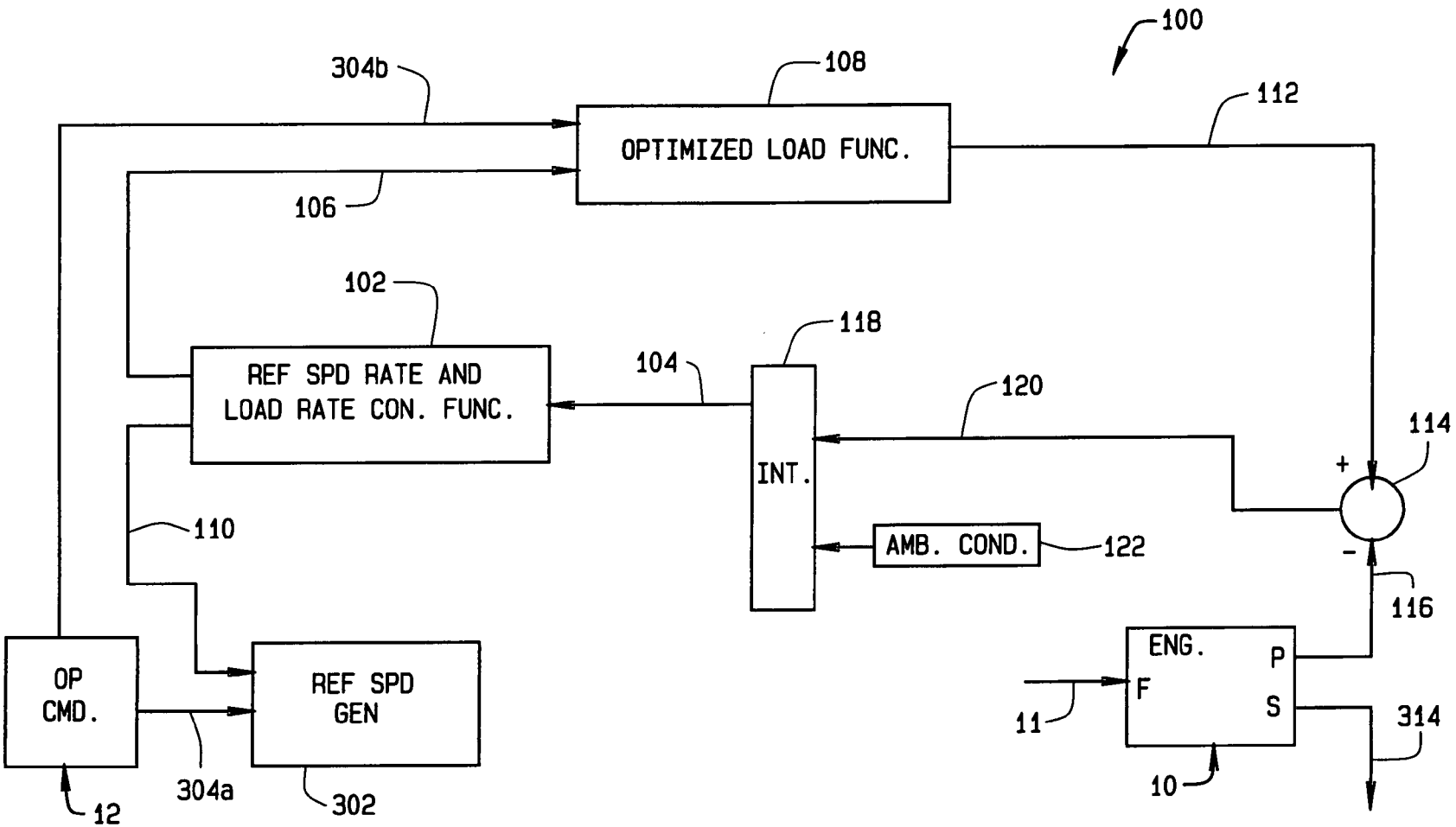
FIGS. 1–3 are simplified flow charts generally illustrating three control loops for implementing the invention; and, FIG. 4 is a simplified flow chart illustrating the interfacing between these loops control so to carry out the invention.
Figure 2:
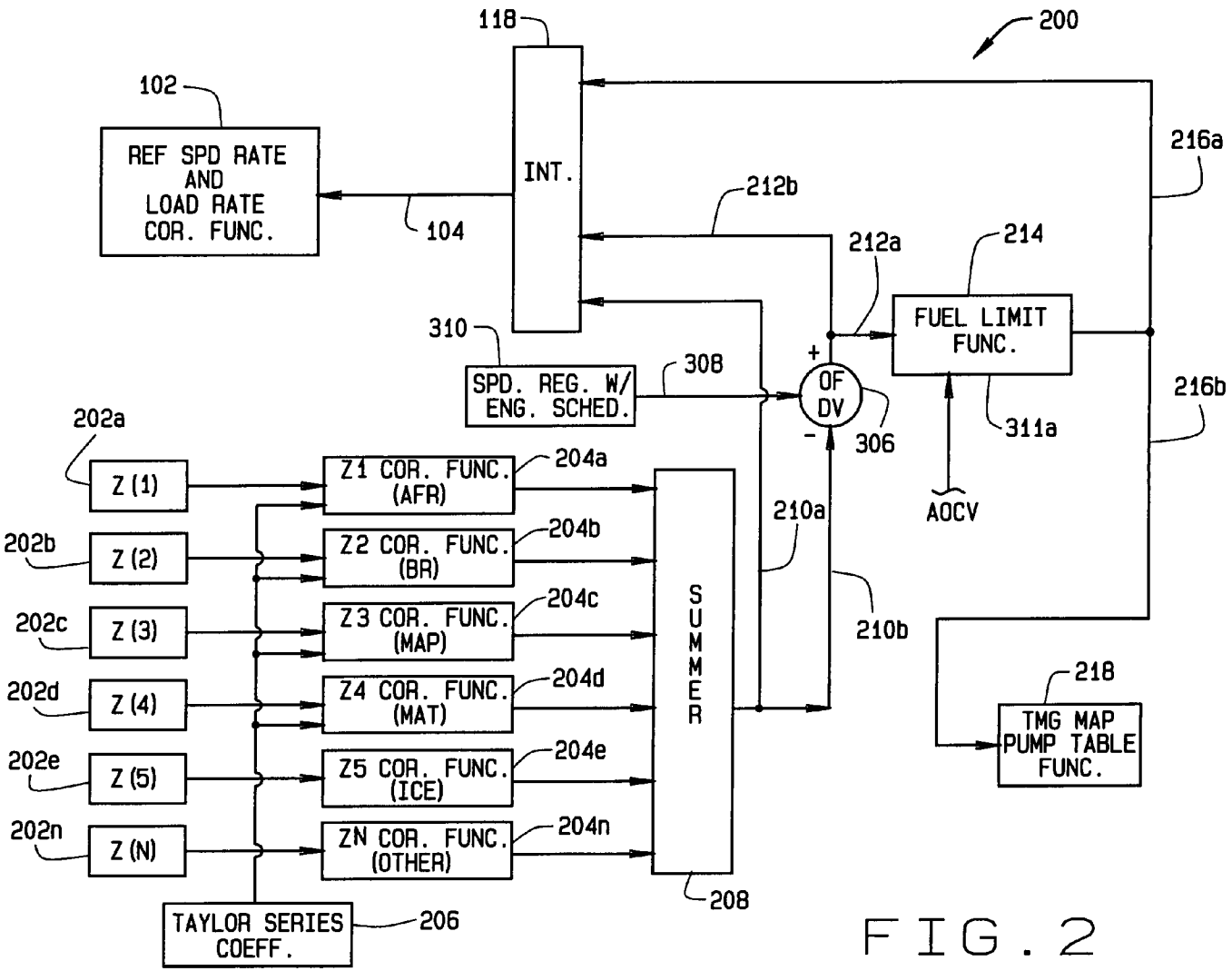
Figure 3:
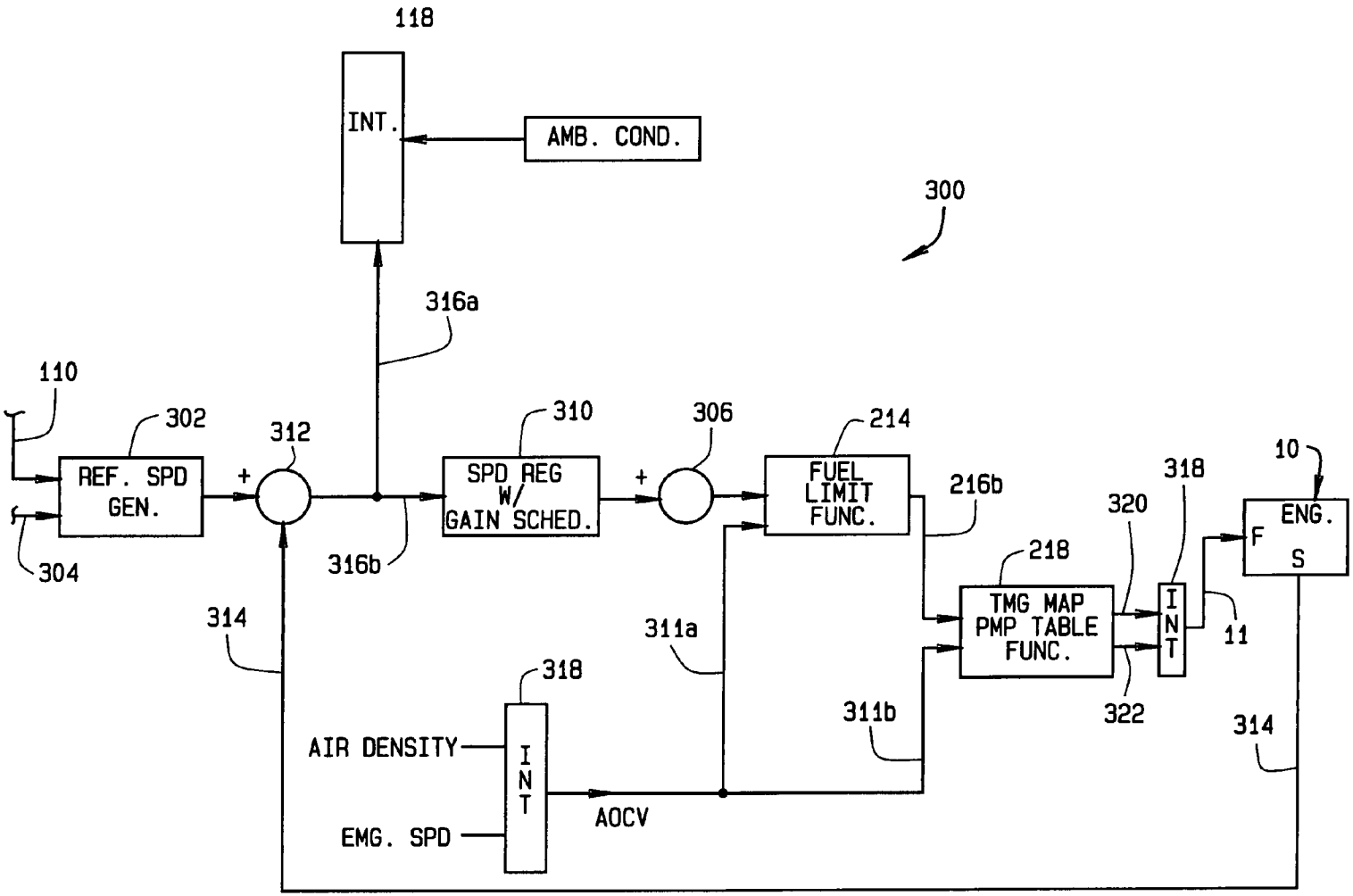
Figure 4:
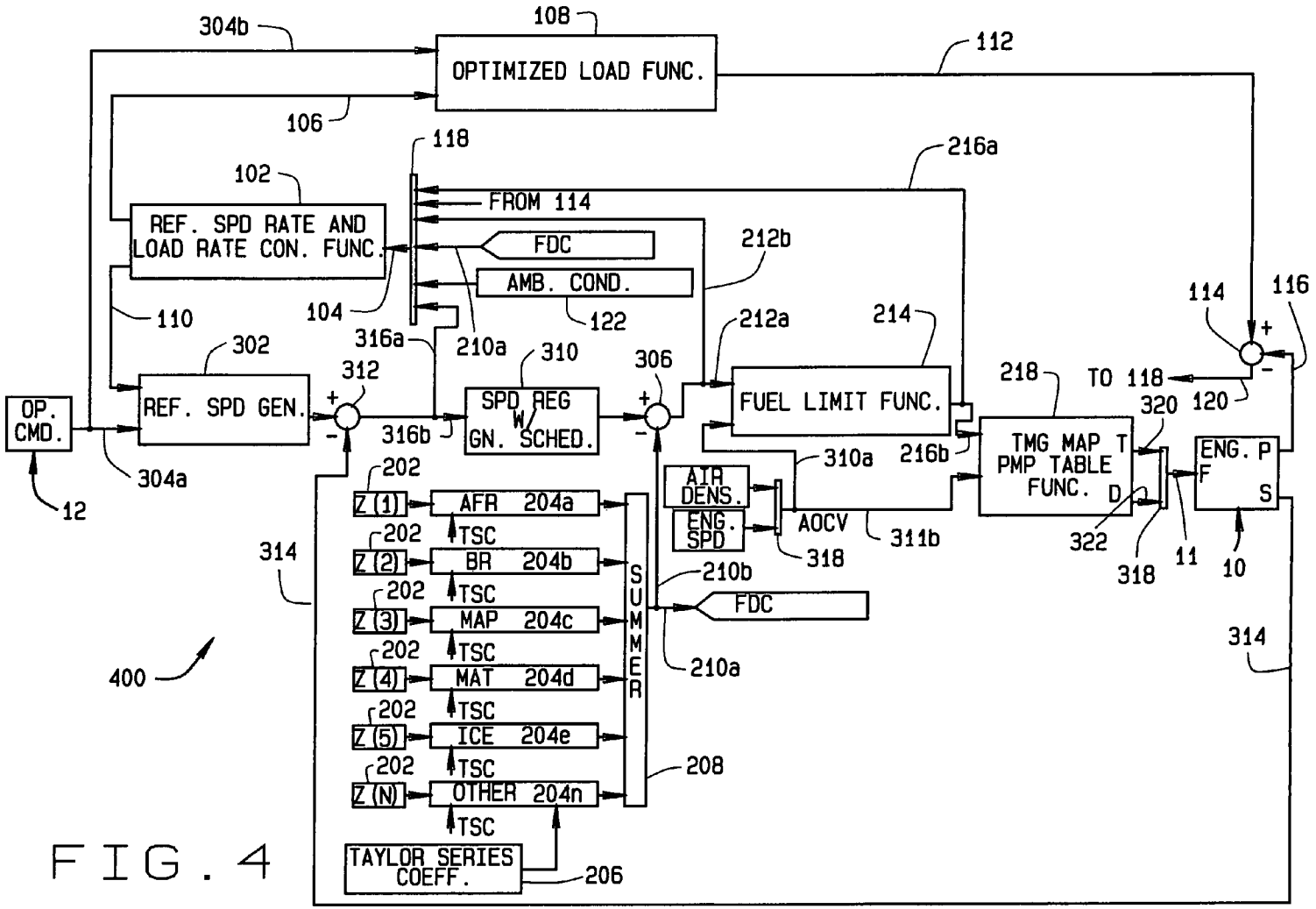

Referring to the drawings, the system and method of the present invention employ an architecture for dynamically controlling operation of a locomotive diesel engine 10. The architecture consists of two inner control loops indicated generally 100 and 200 respectively, and an outer loop indicated generally 300. Loop 100, which is shown in FIG. 1, generally comprises a primary feedback control consisting of a proportional, integral type controller with gain scheduling. This loop functions to regulate engine speed to a commanded slew rate based upon commands from an operator of engine 10. Second loop 200, which is shown in FIG. 2, employs an active feed forward or predictive control which generates a series of fuel demand correction functions. The respective values are generated using Taylor series approximations. Third loop 300, which is shown in FIG. 3, uses inputs from the other two loops to actively control reference speed slew rates, and engine 10 load rates. Loop 300 feeds back actual engine speed and fuel demand information so corrections can be made for predictive purposes. The overall system, including all the loops, is indicated generally at 400 in FIG. 4.

As described hereinafter, the present invention effectively act as a governor on the speed of engine 10. It also operates to provide sufficient fuel to the engine so the engine produces a constant torque even though the load on the engine may vary. Thus, more fuel is supplied to the engine as power demand increases, and less fuel is supplied as power demand decreases. System 400 and the method of the invention also regulate engine power output as a function of engine speed. Regulation is accomplished in real time by looking at previous power demand requirements for various sets of engine operating conditions, anticipating what future requirements for the engine will be, and dynamically controlling supply of fuel to the engine to meet the anticipated demand. In performing these functions, a filtering technique is employed to compensate for wide fluctuations in demand and insure stable engine operation.

In the drawings, a locomotive diesel engine 10 has fuel delivered to it based upon a fuel supply signal F, as indicated at 11. Engine 10 is, for example, a large, medium speed, turbocharged, fuel injected diesel engine of the type used to power railroad locomotives. By combusting the fuel, the engine is able to run at a particular speed S (rpm), and produce a certain amount of power P for the locomotive to drive a load. Measured operating parameters of the engine include values corresponding to both the engine's speed S and the power P produced by the engine. These values are, in part, a function of the amount of fuel delivered to the engine in response to a fuel demand input to a fuel delivery system (not shown) for the engine.

Operational commands (OP CMD.) are provided to system 400 by an engine operator, as indicated at 12, so to control engine performance. These commands (e.g., speed up, slow down, etc.) depend upon the particular set of circumstances surrounding use of the locomotive at any one time. The method of the present invention utilizes the capabilities of each loop 100–300 of system 400 to govern engine performance in response to these operator commands and to various other measured parameters relating to the engine's performance.

In the following discussion, it will be understood by those skilled in the art that various of the modules described employ algorithms to combine various inputs to the modules and generate the resulting output value(s). The digital implementation accomplished within these modules is achieved using either fixed or floating point algorithms. Filtering is applied, as appropriate, to various of the functions to provide system stability.

Loop 100 performs three tasks. These include: i) speed regulation, ii) an optimized response to speed transients, and iii) over speed protection. For these purposes, the loop includes a reference speed rate and load rate correction function module indicated 102 in FIGS. 1 and 4. In exercising this function, one input is a reference speed correction input supplied as indicated at 104. Two outputs are provided by module 102. One output is an optimized load rate correction factor that is provided, as indicated at 106, as an input to an optimized load function module 108. The other output is an optimized reference speed correction that is provided, as indicated at 110, to a reference speed generator 302 of loop 300. Other inputs to reference speed generator 302 are the command inputs from engine operator 12, as indicated at 304*a*. The operator commands are also provided as a second input to optimized load function module 108 as indicated at 304*b*. The output of the optimized load function module is a load request signal provided, as indicated at 112, to a summing point 114. A second input to summing point 114 is a signal indicative of the power output of engine 10, which is provided, as indicated at 116. An output signal indicative of load error from summing point 114 is provided to an integrator module 118, as indicated at 120 in FIG. 1, for use in determining a reference speed correction input for module 102. As described more fully hereinafter, integrator 118 is provided with a number of inputs which are combined together in a predetermined manner to produce the correction signal provided module 102. As indicated at 122, among these inputs are values representing ambient operating conditions AMB COND such as air pressure and air temperature.

The primary tasks performed by loop 200 include: i) fuel demand corrections, based upon the burn rate of delivered fuel, to minimize engine over-fueling; ii) limiting fuel demand based upon the air-fuel ratio of the mixture combusted by the engine; iii) fuel demand corrections, to minimize cooling effects in the combustion chambers of engine 10, based upon the combustion temperature of the combusted mixture; iv) fuel demand correction based upon the density of air in the engine's intake manifold; and v) optimizing the specific fuel consumption (SFC) of the engine. Importantly, control loop 200 provides the predictive capability previously referred to for future engine fuel demand requirements. These are based upon the above and other factors relating to engine performance. In FIG. 2, a number of factors Z relating to the engine's operation are processed, and the results summed together (or otherwise suitably combined) to provide an output used to predict engine fuel requirements. This predictive capability enables system 400 to dynamically and rapidly respond (and in certain aspects to even anticipate) changes in the engine's operating conditions. Doing so provides a faster response time and more efficient control capability than is available with current engine control schemes.

In FIG. 2, among the factors Z utilized are air-fuel ratio (AFR), fuel burn rate (BR), manifold air pressure (MAP), manifold air temperature (MAT), intercooler efficiency (ICE) and other parameters that may impact engine performance generally indicated at OTHER in FIG. 2. The OTHER factors include, for example, the speed of operation of the engine's turbocharger to pressurize air provided to the engine, the turbocharger's efficiency of operation, the density of air in the engine's inlet manifold, and the combustion chamber cooling effect based upon a combustion chamber's temperature.

Sensors 202*a*–202*n* respectively provide input signals representative of each parameter's current value to respective correction function modules indicated 204*a*–204*n*. The correction function modules 204*a*–204*n* each employ a Taylor series. A Taylor series is an expansion of a function about a given value. Each Taylor series expansion includes a constant value (a), a coefficient (b) for the linear term in the expression, a coefficient (c) for the quadratic term in the expression, and so forth. In the control system of the present invention, these coefficients (a), (b), (c), etc. for each term in the respective Taylor series are changeable from an initial set of coefficient values to new values, based upon the particular engine 10 with which the system is employed and the variety of operating conditions encountered by the engine. In FIG. 2, one or more adaptive algorithms are employed in a Taylor Series coefficient module 206 to modify the respective coefficients for each factor, over time, based upon the conditions experienced. Because of the resulting adaptive control capability of the system, each control system 400 will be unique to the engine 10 with which it is used. This further increases the response time, efficiency, and control capability of the system and method than is achievable with current schemes. The respective Taylor series produce values relating to each engine performance parameter used and incorporate both time based (temporal) and cross-functional parameters to produce values which can be used to optimize engine performance.

The output values from the modules 204*a*–204*n* are supplied to a summing module 208 where they are combined to produce a fuel demand correction output, as indicated at 210*a* and 210*b*. The output 210*a* is provided as another input to integrator module 118 which generates the reference speed correction input signal supplied to the reference speed rate and load rate correction module 102. The fuel demand correction FDC output 210*b* is provided to a summing point 306 of loop 300 where it is combined with a fuel demand output 308 from a speed regulator with gain scheduling module 310. The result of the combined fuel demand input value and fuel demand correction values is an optimized fuel demand value OFDV. This value is used to prevent overspeed operation of the engine. It is provided, as indicated at 212*a*, to a fuel limiting function module 214, and at 212*b*, to integrator 118 for use in determining the reference speed correction input to module 102. In module 214, the optimized fuel demand value OFDV is combined with an ambient operating conditions value AOCV, as indicated at 311*a* to produce a fuel limit value supplied, as indicated at 216*a*, as another input to integrator module 118 for determining the reference speed correction input, and at 216*b*, as an input to a timing map and pump table function module 218.

The primary tasks performed by loop 300 include: i) reference speed rate optimization in response to changes in engine load; ii) engine load rate optimization; and iii) reducing exhaust emissions to meet EPA requirements. As previously discussed, loop 300 includes an engine reference speed module 302 whose output is a reference speed value supplied to a summing point 312. A second input to summing point 312 is a speed signal S from engine 10, as indicated at 314. The output from summing point 312 is a speed error input signal (the difference between the engine's actual speed and its expected speed). This signal is provided, at 316*a*, to integrator 118 for use in determining the reference speed correction input to module 102 and, at 316*b*, to the speed regulator and gain scheduling module 310.

Loop 300 also comprises an integrator 318 to which suitable engine parameters, such as engine speed and air density values, are provided. The ambient operating condition value output AOCV from this unit is supplied, as indicated at 311*a*, to fuel limiting function module 214, and at 311*b*, to a timing maps and pump table function module 218. The timing T and duration D outputs of module 218 are supplied to an integrator 318 of loop 300 where they are combined to produce the control signal F controlling the supply of fuel to engine 10, as indicated at 11. Module 218 uses the inputs supplied to it to determine both when fuel should be injected into a combustion chamber, as indicated at 320, and the duration of the fuel injection interval, as indicated at 322, so to provide the fuel control signal F supplied to the engine by integrator unit 318. By taking into account both current engine operating conditions, and by predicting what will be expected of the engine in the immediate future, fuel delivery is controlled so to maximize engine performance (speed and power output) for a current set of circumstances, as well as an expected set of circumstances.

In accordance with the invention, each loop 100–300 of system 400 interacts with each of the other two loops to obtain and process appropriate information by which the fuel control signal F is produced at integrator 318. This results in the appropriate amount of fuel being supplied engine 10, at the appropriate time, so engine 10 operates at a desired speed, produces the requisite amount of power for current conditions, and rapidly responds to drive the engine to a new operating point for expected conditions. By taking into account not only factors such as engine speed and power, but also such factors as air pressure, ambient air temperature, engine temperature, etc., appropriate speed and load correction factors are used to achieve these desired results. Further, an engine derating function is employed which factors into account the time to burn fuel delivered to the engine (based upon current engine speed), and projected fuel cooling. Doing so prevents too much fuel being supplied to the engine, increasing its efficiency, and achieving reduced emissions.

In system operation, the fuel demand correction FDC is adjusted for a number of factors. One is for changes in air pressure due, for example, to changes in the altitude at which the engine is operating. Another factor is the amount of fuel delivered to the engine consistent with maintaining environmental limits on smoke and other EPA regulated emissions. A further factor is not exceeding the maximum safe operating speed of the engine. A fourth factor is not exceeding the operational limits of the engine's cooling system. Yet another factor is when the expected fuel combustion temperature is below an optimum temperature because too much fuel is being supplied to the engine. Further, the fuel demand correction is adjusted if expected fuel combustion time exceeds the period of time necessary for the engine to produce useful work. In each of these instances, the correction value serves to modify the amount of fuel supplied to engine 10.

The present invention can be used for supplying fuel to a single cylinder of engine 10, all of the engine's cylinders, or to a combination of cylinders. System 400 and the method of the invention produce an estimate of fuel demand, then re-calculate the estimate each time fuel is required, so that fuel demand estimates are continuously updated. In addition, fuel demand estimates can be calculated on a periodic or an as needed basis, in accordance with commands from the operator.

In summary, the engine control architecture of system 400 is embodied in the three interrelated control loops 100–300. Loop 100 is the primary feedback control loop. This loop employs an integral type control with gain scheduling and regulates engine speed to commanded slew rates based upon commands from the locomotive's operator. Loop 200 provides an active, feed forward or predictive control consisting of a series of correction functions. As described above, these functions include respective Taylor series each of which has coefficients which can be modified to adapt the control system to the individual locomotive with which the system is used. The results from the respective Taylor series are then combined to produce a fuel demand correction FDC value. Since the sensors 202*a*–292*n* constantly monitor the various parameters affecting engine performance, loop 200 enables a dynamic response to engine performance changes. Loop 300 optimizes reference speed slew rates and engine 10 load rates by providing feedback of nominal engine fuel requirements or fuel demand, corrections to the fuel demand based upon outputs from control loop 200, engine speed error signals, and ambient conditions.

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense.

The invention claimed is:

1. A method of controlling the delivery of fuel to a large, medium speed, multi-cylinder, turbocharged, fuel injected diesel engine of the type used for powering railroad locomotives for providing commanded levels of engine speed and power with efficient combustion of fuel, enhanced engine performance and reduced engine emissions, the method comprising controlling delivery of fuel to the engine to regulate engine speed based on commanded engine speed via a first, feedback control loop; and generating an engine fuel demand correction function based on an engine performance parameter in anticipation of expected engine operations for optimized fuel delivery via a second, predictive control loop.

2. The method of claim 1 further comprising controlling delivery of fuel to the engine via a third control loop receiving inputs from the first and second control loops.

3. The method of claim 1 wherein the fuel demand correction function is determined utilizing Taylor series computations based on the engine performance parameter.

4. The method of claim 3 wherein the engine performance parameter includes an air-to-fuel ratio for fuel delivered to the engine.

5. The method of claim 3 wherein the engine performance parameter includes a fuel burn rate for fuel delivered to the engine.

6. The method of claim 3 wherein the engine performance parameter includes air pressure in an inlet manifold to the engine.

7. The method of claim 3 wherein the engine performance parameter includes air temperature in an inlet manifold to the engine.

8. The method of claim 3 wherein the engine performance parameter includes the density of air in an inlet manifold to the engine.

9. The method of claim 3 wherein the engine performance parameter includes the efficiency of an intercooler for the engine.

10. The method of claim 3 wherein the engine performance parameter includes speed of operation of a turbocharger for pressurizing air provided to the engine.

11. The method of claim 3 wherein the engine performance parameter includes efficiency of operation of a turbocharger for pressuring air provided to the engine.

12. The method of claim 3 wherein the engine performance parameter includes combustion chamber cooling effect based upon combustion chamber temperature.

13. The method of claim 1 wherein the fuel demand correction function is determined utilizing Taylor series computations based on plurality of engine performance parameters.

14. The method of claim 1 wherein a separate Taylor series is utilized for each performance parameter.

15. The method of claim 14 wherein each Taylor series employs coefficients for each factor in the series, and the method further includes modifying each Taylor Series coefficient based upon a range of operating conditions experienced by the engine.

16. The method of claim 1 further comprising limiting the amount of fuel for delivery to the engine to prevent over speed of the engine.

17. The method of claim 2 wherein the three control loops together operate to produce a fuel demand signal for delivery of an optimal amount of fuel to the engine for a set of engine operating conditions.

18. The method of claim 17 further comprising controlling the timing and duration of the injection of fuel to the engine's cylinders based on the optimal fuel demand signal.

19. The method of claim 1 further comprising providing feedback of the actual engine speed and comparing the actual engine speed against an optimized engine reference speed to generate a speed error signal for controlling the delivery of fuel.

20. The method of claim 1 further comprising providing feedback of the actual engine power output and comparing the actual engine power output against an optimized engine load request to generate a load error signal for controlling the delivery of fuel.

21. The method of claim 1 wherein the engine fuel demand correction function is determined in conjunction with each fuel injection operation.

22. The method of claim 1 wherein the engine fuel demand correction function is determined periodically.

23. The method of claim 1 wherein the engine fuel demand correction function is determined upon a change in operator commands for engine speed and power.

24. A system for controlling delivery of fuel to a large, medium speed, multi-cylinder, turbocharged, fuel injected diesel engine of the type used for powering railroad locomotives for providing commanded levels of engine speed and power with efficient combustion of fuel, enhanced engine performance and reduced engine emissions, the system comprising:

a first control loop controlling delivery of fuel to the engine to regulate engine speed based on commanded engine speed, the first control loop being a feedback control loop; and a second control loop generating an engine fuel demand correction signal based on an engine performance parameter in anticipation of expected engine operations for optimized fuel delivery, the second control loop being a second predictive control loop.

25. The system of claim 24 further including a third control loop controlling delivery of fuel to the engine in response to inputs received inputs from the first and second control loops.

26. The system of claim 25 wherein the second control loop employs a Taylor series to generate the fuel demand correction signal, the Taylor series computation being based upon at least one engine performance parameter.

27. The system of claim 26 wherein the second control loop employs a number of Taylor series to generate the fuel demand correction signal, each Taylor series computation being based upon a separate engine performance parameter.

28. The system of claim 27 in which the engine performance parameters include one or more of the following:

an air-to-fuel ratio for fuel delivered to the engine;

a fuel burn rate for fuel delivered to the engine;

air pressure in an inlet manifold to the engine;

air temperature in an inlet manifold to the engine;

air density in an inlet manifold to the engine;

the efficiency of an intercooler for the engine;

speed of operation of a turbocharger for pressurizing air provided to the engine;

efficiency of operation of a turbocharger for pressuring air provided to the engine;

combustion chamber cooling effect based upon combustion chamber temperature.

29. The system of claim 27 in which each Taylor series employs coefficients for each factor in the series, and the system further includes means for modifying each Taylor series coefficient based upon a range of operating conditions experienced by the engine, whereby the system is adapted to the engine with which it is used.

30. The system of claim 25 in which the third control loop controls the timing and duration of the injection of fuel to the engine's cylinders based on the optimal fuel demand signal generated by the second loop.

31. The system of claim 25 further including providing a feedback signal of actual engine speed to the third control loop, the third control loop comparing actual engine speed against an optimized engine speed for generating a speed error signal used in controlling the delivery of fuel to the engine.

32. The system of claim 31 further including providing a feedback signal of the actual engine power output to the first control loop, the first control loop comparing the actual engine power output against an optimized engine load request for generating a load error signal used in controlling the delivery of fuel to the engine.

33. A method of controlling the delivery of fuel to a diesel engine used for powering railroad locomotives to provide commanded levels of engine speed and power with efficient combustion of fuel, enhanced engine performance and reduced engine emissions, the engine operating over a range of speed, load, and environmental conditions, the method comprising:

controlling delivery of fuel to the engine to regulate engine speed based on commanded engine speed via a first control loop;

generating an engine fuel demand correction function based on an engine performance parameter in anticipation of expected engine operations for optimized fuel delivery via a second control loop, the second control loop employing a Taylor series to generate the fuel demand correction signal with the Taylor series computation being based upon an engine performance parameter; and, modifying the Taylor Series as a function of the range of operating conditions experienced by the engine, whereby the system is dynamically adapted to the engine with which it is used.

34. The method of claim 33 wherein the Taylor series employs coefficients for each term in the series, and modifying the series includes modifying each coefficient based upon the range of operating conditions experienced by the engine so to adapt the series to the engine.

35. The method of claim 34 wherein the second control loop employs a number of Taylor series to generate the fuel demand correction signal, each Taylor series computation being based upon a separate engine performance parameter.

36. The method of claim 35 in which each the Taylor series employs coefficients for each term in the series, and the method further includes modifying each coefficient in each Taylor series based upon the range of operating conditions experienced by the engine so to adapt the Taylor series to the engine.

* * * * *